US006446559B1

(12) United States Patent
Vallender et al.

(10) Patent No.: US 6,446,559 B1
(45) Date of Patent: Sep. 10, 2002

(54) SHOTGUN ADAPTER FOR USE TO SHOOT DIFFERENT GUAGE SHELLS

(76) Inventors: Leonard J. Vallender, 11 Clover Rd., Valhalla, NY (US) 10595; Joseph Scancarello, 7 Wadsworth Rd., Glen Rock, NJ (US) 07452

( * ) Notice: Subject to any disclaimer, the term of this patent is extended or adjusted under 35 U.S.C. 154(b) by 0 days.

(21) Appl. No.: 09/835,173

(22) Filed: Apr. 16, 2001

(51) Int. Cl.[7] ..... F42B 8/02
(52) U.S. Cl. ..... 102/446; 42/77; 89/29
(58) Field of Search ..... 102/444, 446, 102/447; 42/77; 89/29

(56) References Cited

U.S. PATENT DOCUMENTS 1,179,021 A * 4/1916 Mayer ..... 102/446
1,555,854 A * 10/1925 Hill ..... 42/77
4,702,170 A * 10/1987 Trudeau ..... 102/446
5,157,210 A * 10/1992 Davis ..... 102/446
5,363,769 A * 11/1994 Bellak et al. ..... 102/446

FOREIGN PATENT DOCUMENTS

GB 2149070 * 6/1985 ..... 102/446

* cited by examiner

*Primary Examiner*—Harold J. Tudor

(57) ABSTRACT

A shotgun adapter is provided for firing a shotgun cartridge having a shotgun bore which is larger than the cartridge. The adapter is a generally hollow tubular member having a cylindrical outer wall and an inner wall concentric with the outer wall, with the inner wall and outer wall being uniquely tapered to specified degrees designed to improve the shooting accuracy when skeet shooting with different gauge cartridges.

3 Claims, 2 Drawing Sheets

SHOTGUN ADAPTER FOR USE TO SHOOT DIFFERENT GUAGE SHELLS

FIELD OF THE INVENTION

This invention relates generally to adapters for shotguns and is particularly related to a shotgun adapter which can be used for shooting different gauge shells from the same shotgun.

BACKGROUND OF THE INVENTION

Several types of shotguns are generally available and are used for a variety of shooting activities and for competing in different types of sport shooting. As mentioned in U.S. Pat. No. 5,448,848 issued to Clifford Moller on Sep. 12, 1995, shotguns are designed to fire pellets, through a barrel with a smooth bore. These shotguns either have a single barrel or they can be double barreled. The bore sizes of the shotguns can range from 12 gauge, 16 gauge, 20 gauge, 28 gauge and 0.410 bore. Since shotgun shooters like to shoot rapidly and accurately attempts have been made to provide new shotguns, or improve the construction of the available shotgun in order to facilitate rapid and accurate shooting, and without increasing the cost of production of the shotguns. Such attempts include providing shotguns which have interchangeable barrels of different gauges. This, of course requires changing the shotgun barrel each time the shooter desires to shoot a different gauge. Some of the prior art suggestions to accommodate the desire of the shotgun shooters are described in U.S. Pat. Nos. 4,989,359 and 5,018,293 which are mentioned in the aforementioned Moller patent. In an attempt to solve the prior art problems, the Moller patent discloses as shotgun having a shotgun barrel tube of specified construction which is complicated and expensive to fabricate and which does not satisfy the foregoing needs of shotgun shooters, particularly those participating in shooting competitions.

In a subsequent patent of Clifford Moller, i.e., U.S. Pat. No. 5,666,756 issued Sep. 16, 1997, Moller describes a shotgun which has lightweight interchangeable barrel tube. Again, the shotgun described in said patent does not meet the needs and objectives of shotgun shooters.

In a somewhat earlier patent, i.e., U.S. Pat. No. 5,157,210 issued to Albert W. Davis on Oct. 20, 1993, Davis discloses a shotgun cartridge adapter for safely firing a shotgun cartridge in a shotgun of a larger gauge. This patent discloses the use of an adapter to be applied and carried with the shotgun cartridge for firing from a shotgun of smaller size cartridge than that for which the gun is chambered. This adapter is cylindrical in form, has generally the same external configuration as the shotgun cartridge, and internal configuration as the gun chamber sized to receive a shell of selected gauge. This construction, however, has inherent disadvantages. Since its inner walls are straight, the shell tends to get stuck in the adapter.

One early patent, i.e., U.S. Pat. No. 3,196,569 issued Jul. 27, 1965 to Daniel J. Thomason discloses an adapter for use with a shotgun of a specified gauge wherein the adapter may be positioned within the shotgun barrel. The adapter may be made in different sizes so that they can be used in conjunction with shotguns of varying gauges. However this adapted, too, is not entirely satisfactory and does not provide the desired shooting speed and accuracy required in skeet and competitive shooting. Thus, there is still a need to provide a shotgun adapter which overcomes the aforementioned problems of the prior art shotguns and shotgun adapters, particularly for use in competitive shooting, such as, skeet shooting and sporting clays.

Accordingly, it is an object of this invention to provide a shotgun adapter for use in shotguns for shooting rapidly and accurately to produce accurate shooting pattern.

It is a further object of the invention to provide a shotgun adapter which permits the use of shotguns capable of shooting different size cartridges without changing the shotgun barrel.

It is another object of this invention to provide a shotgun adapter having unique construction and configuration designed to assure improved pellet patterns.

It is also an object of this invention to provide such a shotgun adapter which is relatively simple and economical to fabricate and convenient to use, particularly for skeet shooting and sporting clays.

The foregoing and other objects of the present invention will be more clearly appreciated and understood from the following detailed description taken in conjunction with the accompanying drawings which form part of this application.

SUMMARY OF THE INVENTION

In accordance with the present invention, a shotgun adapter is provided for firing different gauge shells from the same shotgun. The shotgun adapter is a cylindrical tube having a central bore. The outer wall of the adapter is tapered inwardly at its front end and the inner wall is tapered outwardly toward said end. Both tapered portions are coterminous at the front end, and the rear end of the adapter is machined to receive a shotgun shell. The degree of taper of the outside wall of the adapter is between about 1 and about 1½ degrees and the degree of taper of the inner wall of the adapter is between about 3 and about 3½ degrees. The shotgun adapter may be made of a suitable plastic or metal which can be conveniently fabricated to various gauges.

BRIEF DESCRIPTION OF THE DRAWINGS

In the drawings, wherein like reference numerals are used to designated like parts wherever possible.

DETAILED DESCRIPTION OF THE INVENTION

Figure 2:
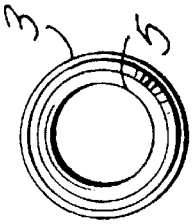
FIG. 2 is a front view of the adapter shown in FIG. 1.
Figure 1:
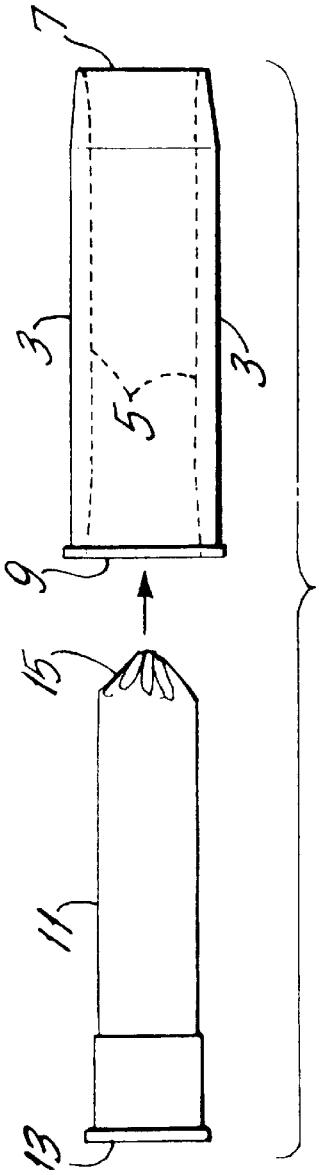
FIG. 1 is a side exploded view of the adapter of this invention and a shotgun shell.

Referring first to FIG. 1, there is shown the adapter of this invention generally designated by the numeral 1. The adapter 1 is a generally cylindrical in configuration comprising outer wall 3 and inner wall 5 (shown in dotted line) which is of slightly less diameter than the outside diameter of the adapter. The adapter 1 has opposed open ends 7 and 9 for insertion therethrough of a shotgun shell (cartridge) 11 shown below the adapter 1. The shotgun shell 11 is also cylindrical in configuration with an outside diameter slightly less than the inside diameter of the adapter in order to fit snugly therein. The shotgun shell 11 has a closed locked end 13 and a crimped forward end 15 for easy insertion of the shotgun shell through the adapter.

For optimum shooting patterns from a shotgun incorporating the adapter of this invention, the adapter must have certain design and dimensions which are of paramount consideration. The significance of these features will become apparent from the ensuing description. Thus, the inner and outer walls of the adapter must be tapered slightly such that the outer walls are tapered inward while the inner walls are tapered correspondingly outward as shown in FIG. 1. Thus, the relative dimensions and degree of taper of the walls of the adapter are paramount to the efficacy of the adapter when used to shoot different gauge shells from the same shotgun without changing the gun barrel. Best shooting patterns are achieved when the degree of taper of the outside wall is between about 1 and about 1.5 degrees and the degree of taper of the inner wall is between 3 and 3.5 degrees.

Figure 3:
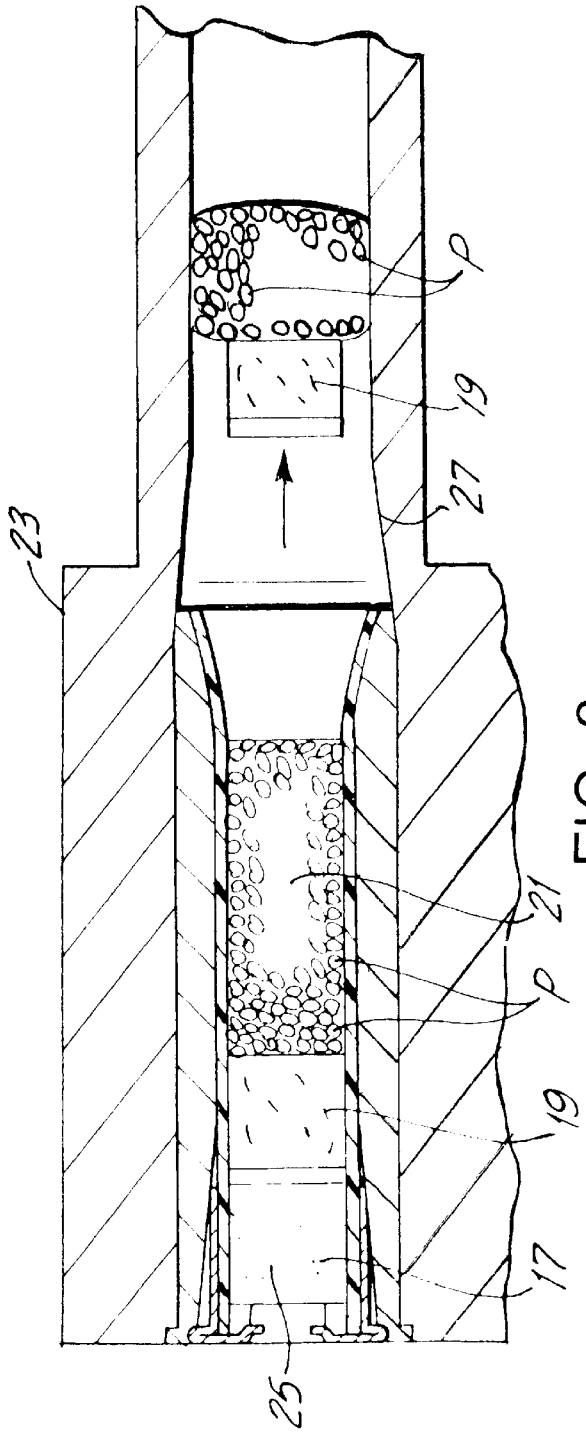
FIG. 3 is a cross sectional view of the adapter shown in FIG. 1.
Figure 4C:
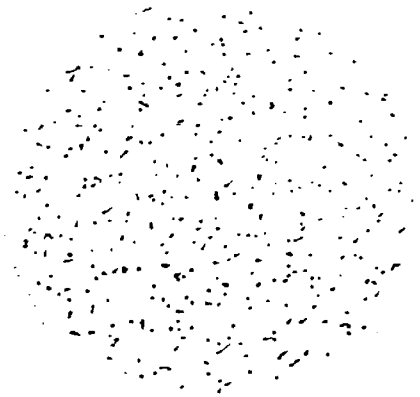
FIGS. 4*a*, 4*b*, 4*c* and 4*d* illustrate shooting patterns resulting from skeet shooting using different size shells, i.e., 12, 20, 28 and 0.410 gauge, from the same shotgun, using the adapter of the present invention.
Figure 4A:
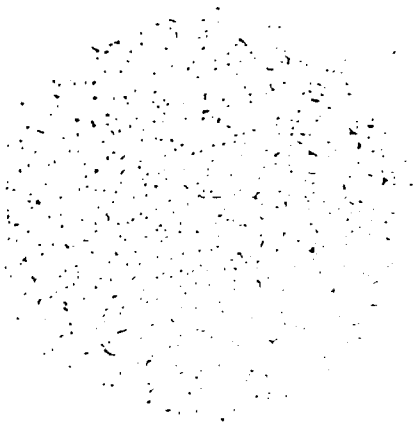
Figure 4D:
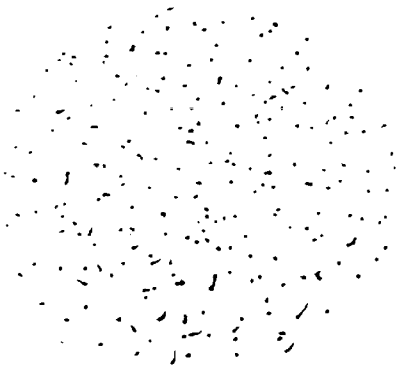
Figure 4B:
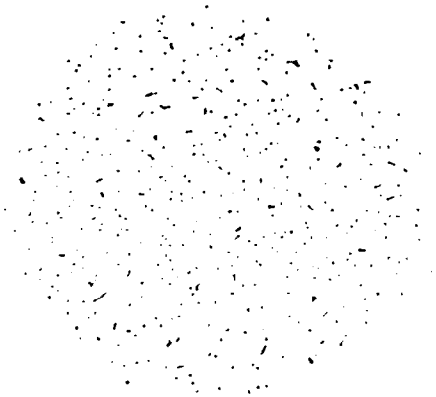

The advantages of using the shotgun adapter of this invention can be appreciated by reference to its use as illustrated in FIG. 3. In general, before shooting, gun powder is added to the shotgun cartridge, e.g., a 12 gauge cartridge, in chamber 17 and a plastic wad 19 is then inserted in the cartridge and pressed down against the powder in said chamber. Shotgun pellets (lead pellets) P are then added to the shotgun shell column 21 and the top end of the shotgun shell end which is crimped to insert the shell into the shotgun adapter 1, and the shotgun adapter 1 is inserted into the shotgun barrel 23. The shotgun is now loaded and ready to fire. Upon striking the shotgun primer, the primer 25 is activated, the powder in chamber 17 is ignited and the wad 19 and the pellets P are ejected through the shotgun barrel 23 toward the desired target. When the shotgun is fired, the shot pellets and the wad are ejected into the shotgun barrel 23. As a result of heat and pressure generated due to firing the shotgun, the front outwardly tapered end of the adapter opens up against the forcing cone 27 defined by the inside walls of the inner tub 27 the gun barrel 23. This permits a smaller gauge shell to open centrally into a larger gauge gun barrel. The front tapered end of the adapter which has opened into the forcing cone 27 serves to retain the shot column centralized in the inner gun tube 27 and as the shot column is ejected toward the target, thus resulting in more accurate shooting at the target. Meanwhile, the wad 19 drops out to the ground and the shotgun shell is extracted from the rear of the adapter.

FIGS. 4*a*, 4*b*, 4*c* and 4*d* illustrate the shooting accuracy achieved by skeet shooting with different gauge cartridges all used with the adapter of this invention in the same shotgun. As it can be seen from FIGS. 4*a*, 4*b*, 4*c* and 4*d*, the shooting pattern in each case was 92% which means that 92% of the shot pellets from the shot column using different gauge cartridges hit their respective targets.

The adapter of the present invention is usually fabricated from any suitable metal such as steel, stainless steel or other suitable metal, or it may even be made from a suitable plastic of the type generally used in the prior art. Regardless of the type of material used to make the adapter, it may be fabricated and machined with precision such as to have inwardly tapered outer walls and outwardly tapered inner walls which, upon firing the gun, is capable of opening up to mate with the forcing cone of the gun barrel, thus sustaining the column of the shotgun pellets as the pellets are ejected from the shotgun toward the target.

Although, the shotgun adapter of this invention has been described with a certain degree of particularity, several changes and/or modifications may be made which are obvious from the foregoing detailed description. Such changes and modifications are nevertheless within the scope of this invention.

What is claimed is:

1. A shotgun adapter for firing a shotgun cartridge having a shotgun bore larger than said cartridge, said adapter having a hollow tubular member comprising opposed axially disposed front and back open ends, a generally cylindrical outer wall and an inner wall concentric with said outer wall, wherein said outer wall has an inwardly tapered portion at said front end with a degree of taper from about 1 to about 1½ degrees, and said inner wall has an outwardly tapered portion at said front end, with a degree of taper of from about 3 to about 3½ degrees, both said tapered portions being coterminous at said front open end of said adapter.

2. A shotgun adapter as in claim 1 wherein said adapter is made of metal.

3. A shotgun adapter as in claim 1 wherein said adapter is made of plastic.

* * * * *